US005232806A

United States Patent [19]

Yamada et al.

[11] Patent Number: 5,232,806

[45] Date of Patent: Aug. 3, 1993

[54] MAGNETIC DEVELOPER FOR ELECTROPHOTOGRAPHY

[75] Inventors: Shigeki Yamada, Nara; Hidenori Asada, Hirakata; Takeshi Arakawa, Osaka; Nobuyuki Tsuji, Kakogawa, all of Japan

[73] Assignee: Mita Industrial Co., Ltd., Osaka, Japan

[21] Appl. No.: 801,506

[22] Filed: Dec. 2, 1991

[30] Foreign Application Priority Data

Nov. 30, 1990 [JP] Japan ..... 2-334581

[51] Int. Cl.[5] ..... G03G 9/107

[52] U.S. Cl. ..... 430/106.6; 430/903; 430/137

[58] Field of Search ..... 430/110, 111, 106.6, 430/137

[56] References Cited

U.S. PATENT DOCUMENTS 4,526,851 7/1985 Boughton et al. ..... 430/106.6
4,820,603 4/1989 Sakashita ..... 430/106.6
4,973,541 11/1990 Kohri et al. ..... 430/111

*Primary Examiner*—John Goodrow
*Attorney, Agent, or Firm*—Sherman and Shalloway

[57] ABSTRACT

Disclosed is a one-component magnetic developer for the electrophotography, which comprises one-component magnetic toner particles and at least one fine particulate additive selected from the group consisting of hydrophobic silica, hydrophilic silica and alumina, wherein the one-component magnetic toner particles have a sphericity degree (DS), defined by the following formula, of 70 to 90%, and a specific surface area of 1.4 to 2.0 $m^2/g$:

$$DS = Cc/CT \quad (1)$$

wherein Cc represents the outer circumference of a circle having the same area as the projected area of the toner, and CT represent the actual outer circumference of the projected plane of the toner. This developer is excellent in the flowability and can provide an image having a high density.

6 Claims, 3 Drawing Sheets

MAGNETIC DEVELOPER FOR ELECTROPHOTOGRAPHY

BACKGROUND OF THE INVENTION (1) Field of the Invention

The present invention relates to a one-component magnetic developer for use in the electrophotography. More particularly, the present invention relates to a one-component magnetic developer which shows excellent flowability and other developing performances at the development, which prominently improves the image density and image quality of a formed image.

(2) Description of the Related Art

In a one-component magnetic developer, toner particles are frictionally charged with one another and the charged toner particles form a magnetic brush on a developing sleeve having magnets arranged therein, and the magnetic brush is brought into sliding contact with a photosensitive material having an electrostatic image formed thereon to form a toner image. Alternatively, a toner layer is formed on the developing sleeve, and development is carried out under such conditions that vibration or flying of the charged toner is caused between the developing sleeve and the photosensitive material on the surface of the photosensitive material close to the surface of the developing sleeve.

Methods for improving the chargeability and electric characteristics of this one-component developer and further improving the flowability by sprinkling various fine powders on magnetic toner particles have been conducted from old.

For example, the specification of U.S. Pat. No. 3,639,245 teaches that one-component electroconductive magnetic toner particles are sprinkled with gas-phase method silica, and the specification of U.S. Pat. No. 4,082,681 teaches that one-component magnetic toner particles are sprinkled with electroconductive carbon black.

Japanese Unexamined Patent Publication No. 58-1157 teaches that one-component magnetic toner particles or ordinary toner particles are sprinkled with hydrophobic gas-phase method silica together with gas-phase method titania, gas-phase method alumina or hydrophilic gas-phase method silica.

It is considered that these proposals are significant in that the chargeability and flowability of toner particles are improved by incorporating additives of the silica type or the like into toner particles of a one-component magnetic developer. However, in these proposals, only the kind, particles size and amount of the additive are defined. In the state where the developer is practically used, the relation between the toner particles and the additive particles are greatly influenced by the shape and physical properties of the toner particles, but any proposal is not substantially made as regards the toner particles. Moreover, the dispersion state or dispersion structure of the additive on the surfaces of toner particles are not referred to.

SUMMARY OF THE INVENTION

The present inventors found that the dispersion states and dispersion structures of toner particles and fine additive particles in a one-component magnetic developer are greatly influenced by the shape and physical properties of the toner particles as well as the above-mentioned kind, particle size and amount of the additive, the dispersion states and dispersion structures are also greatly influenced by conditions of compounding both the components, and that if toner particles having a specific shape and specific physical properties are selected and preferably, if the state of dispersion or adhesion of the fine perticulate additive to the toner particles is controlled within a specific range, the chargeability of the toner and the stability of this chargeability, and the flowability of the toner are conspicuously improved, whereby the image density can be prominently increased.

It is therefore a primary object of the present invention to provide a one-component magnetic developer for the electrophotography, comprising one-component magnetic toner particles and a fine particulate silica and/or alumina type additive, in which the chargeability of the toner and the stability of this chargeability, and the flowability of the toner are conspicuously improved, and which can provide a toner image having a high density.

Another object of the present invention is to provide a one-component magnetic developer for the electrophotography, in which fine particulate silica and/or fine particulate alumina is made present on the surfaces of toner particles in such a dispersion state or dispersion structure that the frictional chargeability and flowability are most effectively improved.

In accordance with the present invention, there is provided a one-component magnetic developer for the electrophotography which comprises one-component magnetic toner particles and at least one fine particulate additive selected from the group consisting of hydrophobic silica, hydrophilic silica and alumina, wherein the one-component magnetic toner particles have a sphericity degree (DS), defined by the following formula, of 70 to 90%, and a specific surface area of 1.4 to 2.0 $m^2/g$:

$$DS = Cc/CT \quad (1)$$

wherein Cc represents the outer circumference of a circle having the same area as the projected area of the toner, and CT represent the actual outer circumference of the projected plane of the toner.

In one preferred embodiment of the present invention, the additive adheres in the form of particles having a particle size of 20 to 100 nm outside the surfaces of the toner particles so that the area coverage ratio to the toner particles is 3 to 30%.

In another preferred embodiment of the present invention, the silica additive adheres in the form of particles having a particle size of 20 to 100 nm outside the surfaces of the toner particles so that the are coverage ration to the toner particles is 3 to 30%, and the alumina additive adheres in the form of particles having a particle size of 100 nm to 1 μm outside the surfaces of the toner particles so that the area coverage ratio to the toner particles is 0.1 to 3%.

DETAILED DESCRIPTION OF THE INVENTION

Figure 1:
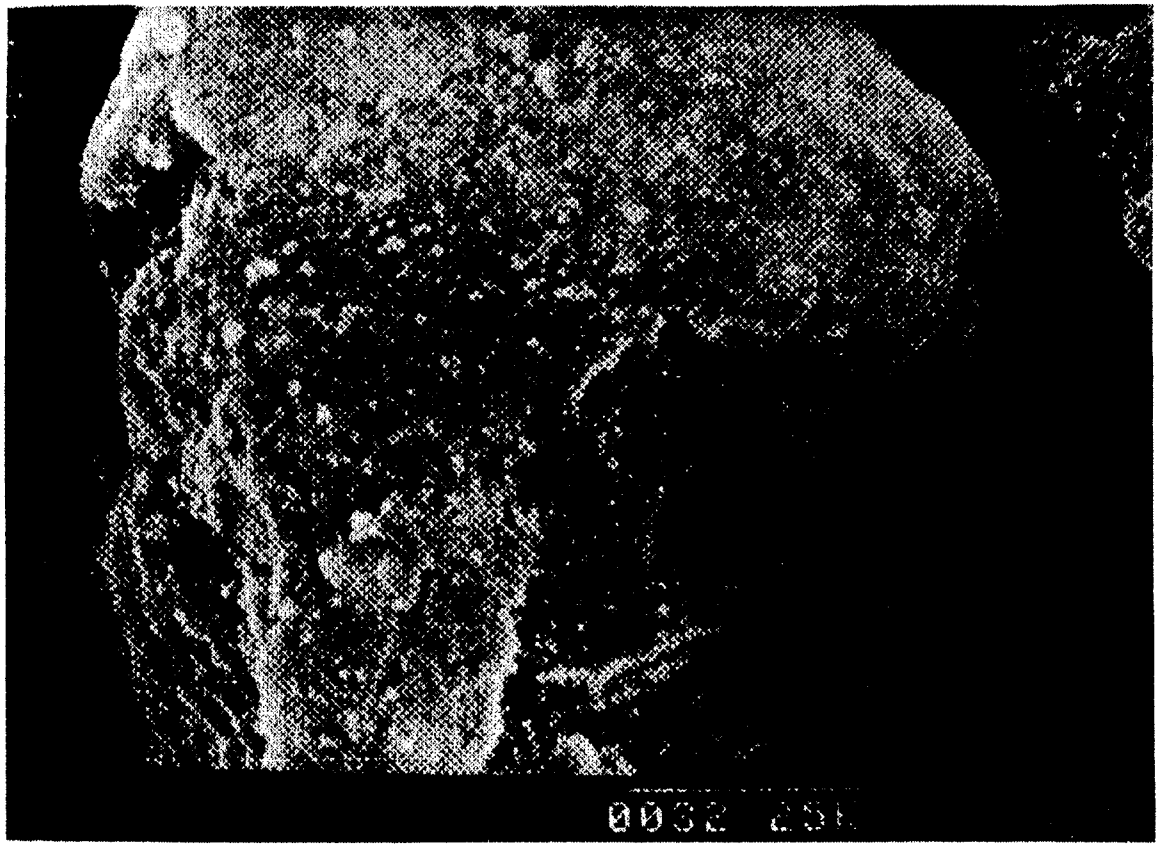
FIG. 1 is a scanning type electron microscope photo illustrating the particulate structure of the one-component magnetic developer of the present invention.

The present invention is based on the finding that in the final developer where silica or alumina additive particles are dispersed and caused to adhere, the sphericity degree (DS) and specific surface area of the magnetic toner particles have serious influences on the chargeability and flowability and, finally on the image density and image quality. More specifically, it has been found that it the sphericity degree exceeds the range defined in the present invention and higher than 90%, or the sphericity degree is lower than 70%, the image density is reduced as compared with the image density attained by the present invention. It has also been found that in the toner having the above-mentioned sphericity degree, in order to form an image having a high density without scattering of the toner or occurrence of fogging, the specific surface area of the magnetic toner particles should be controlled within a narrow range of 1.4 to 2.0 $m^2/g$. Although the reason is precisely indefinite, the present inventors construe as follows.

The sphericity degree (DS) of the magnetic toner particles has relations to both of the degree of coverage of the surfaces of the toner particles with the silica and alumina additives and the contribution of the adhering toner particles to the frictional chargeability. If the particle size and amount of the additive particles are constant, a larger sphericity degree gives a larger coverage of the toner particles with the additive particles, as compared with the coverage given by a smaller sphericity degree. As described in detail hereinafter, if the degree of coverage of the surfaces of the toner particles exceeds a certain standard, the charge quantity of the toner becomes too large and the amount of the toner adhering to the electrostatic image decreases, resulting in reduction of the image density. If the degree of coverage of the surfaces of the toner particles is below a certain standard and is too small, the charge quantity of the toner becomes too small and the amount of the toner adhering to the electrostatic image becomes to small, resulting in reduction of the image density. Furthermore, as the particulate shape is closer to a spherical shape (as the sphericity degree is larger), the ratio of the portion making a contribution to the internal frictional charging in the surfaces of the particles increases. In contrast, if the shape of the particles is a flat or concave-vonvex shape different from the spherical shape, the area of a shadow portion, that is, a portion making no contribution to the frictional charging, tends to increase. Because of the above facts in combination, in the case where a silica or alumina additive is caused to adhere to magnetic toner particles, it is considered that the sphericity degree of the toner particles has a great influence on the image density. Moreover, by adjusting the sphericity degree of the magnetic toner particles within the above-mentioned range, the flowability of the developer can be improved.

In the present invention, if the specific surface area of the magnetic toner is outside the above-mentioned range, even if the sphericity degree is within the range specified in the present invention, reduction of the image density cannot be avoided. The reason is considered to be that the charge quantity is outside the optimum range. If the specific surface area exceeds the above-mentioned range, scattering of the toner or occurrence of the fogging tends to increase, and if the specific surface area of the toner is below the above-mentioned range, the developing operation adaptability is reduced.

In general, the specific surface area of the magnetic toner particles is influenced not only by the particle shape but also the particle size and particle density. Supposing that the shape of the magnetic toner particles is spherical, the particle size is DT ($\mu$m) and the density of the particles is $\rho$ ($g/cm^3$), the specific surface area ST ($m^2/g$) is expressed by the following formula:

$$ST = 6/(DT \cdot \rho) \tag{2}$$

Empirically, it has been confirmed that in view of the density or quality of the formed image, ST should be in the range of from 1.4 to 2.0 $m^2/g$. Accordingly, it has been clarified that the particle size of the magnetic toner should satisfy the following requirement:

$$DT = (3 \text{ to } 4.3)/\rho \tag{3}$$

Namely, in order to satisfy the requirement of the formula (3), the particle size should be decreased if the density is high and the particle size should be increased if the density is low.

In the one-component magnetic developer of the present invention, at least one fine particulate additive selected from the group consisting of hydrophobic silica, hydrophilic silica and alumina is caused to adhere to the above-mentioned one-component magnetic toner particles. It is preferred that the additive be made adhering in the form of particles having a particle size of 20 to 100 nm outside the surfaces of the toner particles so that the area coverage ratio to the toner particles is 3 to 30%, especially 5 to 20%.

In the present invention, the state where the silica or alumina additive "adhering outside the surfaces of the toner particles" means the state where the additive particles are present outside the surfaces of the toner particles but they adhere to the toner particles. Accordingly, additive particles which are free particles separating from the toner particles or which are at least half or completely embedded in the surfaces of the toner particles are excluded. Furthermore, in the present invention, the particles size of the silica or alumina additive particles is different from the primary particle diameter ordinarily referred to with respect to silica or alumina additives. That is, the size of the shape of particles practically present on the surfaces of the toner particles is meant, which is actually measured from a scanning electron microscope (SEM) photo. Still further, the area coverage ration to the toner particles means the ratio (percentage) at which the area of the toner particles is covered with the projected area of the silica or alumina additive. The specific value of this ratio is determined from the above-mentioned scanning electron microscope photo according to the following formula:

$$C = \frac{\sum_{i=1}^{n} Si \cdot m}{S} \times 100 \tag{4}$$

wherein C represents the area coverage ration, S represents the projected area of the toner, Si represents the projected area of additive particles, and m is the number of particles having the area Si.

Figure 2:
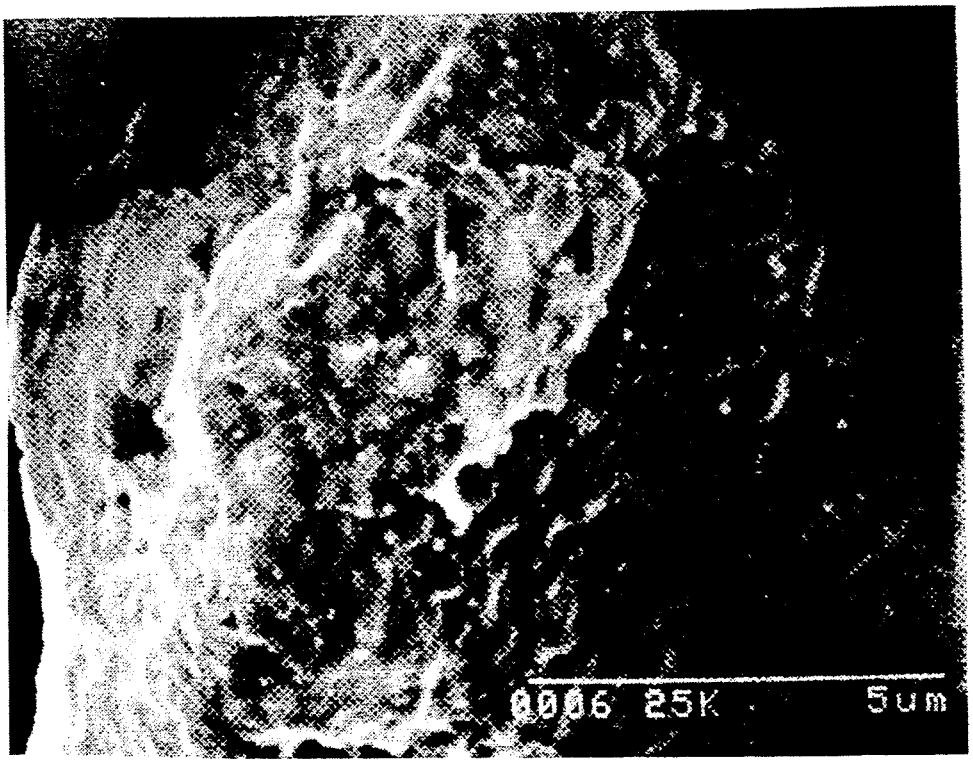
FIG. 2 is a scanning type electron microscope photoillustrating the particulate structure of the one-component magnetic developer of the present invention, in which the silica additive and the alumina additive are embedded in the toner particles.

FIG. 1 of the accompanying drawings is a scanning type electron microscope photo (10,000 magnifications) showing the particulate structure of the one-component magnetic developer of the present invention. FIG. 2 is a scanning type electron microscope photo (same magnifications) showing the particulate structure of a one-component magnetic developer comprising a silica or alumina additive embedded in toner particles. From these photos, the above-mentioned fine dispersion structure in the developer of the present invention can be understood. When one-component magnetic toner are stirred and mixed with a fine particulate silica or alumina additive, the silica or alumina additive is first adheres to the surfaces of the toner particles in the form of agglomerated, relatively coarse particles, and as stirring is continued, the additive becomes present on the surfaces of the toner particles in the form of fine particles and the number of the additive particles present on the surfaces of the toner particles decreases. The fact that the number of the silica or alumina additive particles present on the surfaces of the toner particles decreases at the final stage seems strange because the once added silica or alumina additive should not be lost at all. However, this fact will be explained without any contradiction, if it is construed that the added silica or alumina additive is embedded and absorbed in the toner particles.

In fact, if with respect to each of the one-component developers obtained t the primary stage, the final stage and the intermediate stage, the image density and flowability are tested, the following facts can be confirmed. Namely, in the developer obtained at the primary stage, the silica or alumina additive is readily separated from the toner particles and no improvement of the image density or flowability is expected. In the developer obtained at the final stage, the image density or the flowability of the toner particles is hardly improved over that of the developer to which the silica or alumina additive is not added.

From the foregoing facts, it is understood that for the chargeability and flowability of toner particles, it is important that the silica or alumina additive incorporated in the one-component magnetic toner should be present on the surfaces of the toner particles with a specific particle size in a specific adhesion or dispersion state.

In the present invention, if the adhering particle size of the additive is larger than 100 nm, the additive particles separate from the toner particles, a satisfactory chargeability or a good charge stability cannot be obtained, and the flowability is degraded. If the particle size of the additive particles is smaller than 20 nm, the chargeability or the charge stability tends to decrease and also the area coverage ratio (C) is reduced. If the area coverage ratio (C) is lower than 3%, the charge quantity of the toner is reduced and the image density is much lower than in the present invention. If the coverage ratio (C) is higher than 30%, the charge quantity of the toner becomes too high, and the image density is lower than in the present invention.

According to a most preferred embodiment of the present invention, a silica additive is made adhering in the form of particles having a particle size of 20 to 100 nm outside the surfaces of toner particles so that the area coverage ratio to the toner particles is 3 to 30%, and an alumina additive is made adhering in the form of particles having a particle size of 100 nm to 1 μm outside the surfaces of the toner particles so that the area coverage ratio to the toner particles is 0.1 to 3%. According to this preferred embodiment, an excellent dispersion structure and an optimum chargeability can be obtained.

One-Component Magnetic Toner

The one-component magnetic toner of the present invention satisfies the above-mentioned requirements of the sphericity and specific surface area. In general, a one-component magnetic toner composition is formed by dispersing a magnetic material powder, optionally together with a charge-controlling agent, into a fixing, electrically insulating medium. A toner having a sphericity degree satisfying the requirement of the formula (1) can be prepared according to a known process for forming a spherical toner. As the toner-sphering process, there have been known various processes, for example, a process in which a molten composition is spray-granulated in a cooling atmosphere, a process in which a solution or dispersion of the composition is a spray-granulated in a drying atmosphere, a process in which indeterminate particles obtained by the kneading pulverizing method is sphered by hot air or the like (Japanese Unexamined Patent Publication No. 56-52758, Japanese Unexamined Patent Publication No. 58-134650 and Japanese Unexamined Patent Publication No. 59-127662), a process in which a rough pulverization product of the composition is finely pulverized and simultaneously sphered by hot air (Japanese Unexamined Patent Publication No. 61-61627), a process in which indeterminate particles formed by the kneading pulverization of the composition is sphered in a gas phase by a mechanical impact force (Japanese Unexamined Patent Publication No. 63-235953), and a process in which spherical particles are directly prepared by suspension, dispersion or emulsion polymerization (Japanese Unexamined Patent Publication No. 56-121048). Any of these processes can be applied to the preparation of the magnetic toner particles used in the present invention. The sphericity degree can be adjusted to a desired level by changing the temperature of the hot air or atmosphere used, or by changing the residence time in the granulating zones.

As the magnetic powder, there can be used known materials, for example, ferromagnetic metals and alloys such as iron, cobalt and nickel, and compounds thereof. Magnetite ($Fe_3O_4$) and ferrities are preferably used as the ferromagnetic compound. A magnetic powder having a particle size of 0.1 to 3 microns is preferably used.

As the fixing medium in which the magnetic powder is dispersed, there can be used a resin, a waxy substance and a rubber, which show a fixing property under application of heat or pressure. These media can be used singly or in the form of a mixture of two or more of them. It is preferred that the volume resistivity of the fixing medium be at least $1\times10^{15}$ Ω-cm as determined without incorporation of magnetite.

Homopolymers and copolymers of monoethylenically and diethylenically unsaturated monomers, especially (A) vinyl aromatic monomers and (B) acrylic monomers, are used as the fixing medium.

As the vinyl aromatic monomer, there are preferably used monomers represented by the following formula:

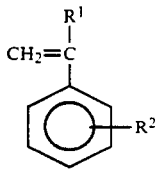

wherein $R^1$ represents a hydrogen atom, a lower alkyl group (having up to 4 carbon atoms) or a halogen atom, and $R^2$ represents a substituent such as a lower alkyl group or a halogen atom, such as styrene, vinyltoluene, α-methylstyrene, α-chlorostyrene and vinylxylene, and vinylnaphthalene. Of these monomers, styrene and vinyltoluene are especially preferably used.

As the acrylic monomer, there are preferably used acrylic monomers represented by the following formula:

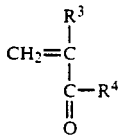

wherein $R^3$ represents a hydrogen atom or a lower alkyl group, and $R^4$ represents a hydroxyl group, an alkoxy group, a hydroxyalkoxy group, an amino group or an aminoalkoxy group, such as acrylic acid, methacrylic acid, ethyl acrylate, methylmethacrylate, butyl acrylate, butyl methacrylate, 2-ethylhexyl acrylate, 2-ethylhexyl methacrylate, 3-hydroxypropyl acrylate, 2-hydroxyethyl methacrylate, 3-N,N-diethylaminopropyl acrylate and acrylamide.

As the other monomer used singly or in combination with the monomer (A) or the monomer (B), there can be mentioned, for example, conjugated diolefin monomers represented by the following formula:

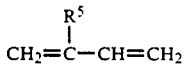

wherein $R^5$ represents a hydrogen atom, a lower alkyl group or a chlorine atom, such as butadiene, isoprene and chloroprene, ethylenically unsaturated acids such as maleic anhydride, fumaric acid, crotonic acid and itaconic acid, asters thereof, vinyl esters such as vinyl acetate, and vinylpyridine, vinylpyrrolidone, vinyl ethers, acrylonitrile, vinyl chloride and vinylene chloride.

It is preferred that the molecular weight of the vinyl polymer be 3,000 to 300,000, especially 5,000 to 200,000.

In the one-component magnetic toner used in the present invention, the relation between the density and particle size, defined by the above-mentioned formula (3), should be satisfied. Since the density increases with increases of the content of the magnetic powder, also the particle size depends on the content of the magnetic powder. However, if the content of the magnetic powder is too low, the magnetic attractive force is weak and if the content of the resin is too low, the fixing property is degraded, and therefore, the contents of the magnetic powder and the resin should naturally be limited. It is generally preferred that the amount used of the magnetic powder be 35 to 75% by weight, especially 40 to 70% by weight, based on the total amount of the magnetic powder and resin, so that the density of the magnetic toner is 1.1 to 2.0 g/cm$^3$, especially 1.3 to 1.7 g/cm$^3$. Known additive components for the developer can be incorporated into the toner particles according to a known recipe. For example, at least one member selected from the group consisting of pigments such as carbon black and dyes such as Acid Violet can be used for improving the hue of the developer. For attaining a bulking effect, a filter such as calcium carbonate or finely divided silica can be incorporated in an amount of 20% by weight based on the toner composition. In the method of fixing the developer by a hot roll, an offset-preventing agent such as a silicone oil, a low-molecular-weight olefin resin or a wax can be used in an amount of 2 to 15% by weight based on the entire composition. In the method of fixing the developer by a pressure roll, a pressure fixability-imparting agent such as paraffin wax, an animal wax, a vegetable wax or a fatty acid amide can be incorporated in an amount of 5 to 30% by weight based on the entire composition. For controlling the charge polarity, a charge-controlling agent such as a complex salt azo dye containing chromium, iron or cobalt can be incorporated. The particle size (diameter) of the one-component magnetic toner particles should satisfy the requirement of the above-mentioned formula (3). Although this particle size depends on the density and the resolving power, it is preferred that the particle size be 5 to 35 microns in the range satisfying the requirement of the formula (3).

Silica or Alumina Additive

In the present invention, at least one member selected from the group consisting of hydrophobic silica, hydrophilic silica and alumina is used as the fine particulate additive made adhering to the toner surface. This hydrophobic silica is gas-phase method silica formed by subjecting silicon chloride to high-temperature (flame) hydrolysis and treating the obtained fine silica with a silane such as dimethyldichlorosilane to block the surface silanol with the organosilane. Accordingly, this silica is more highly hydrophobic than ordinary gas-phase silica, and an excellent moisture resistance and a good storage property can be given to the toner particles. It is preferred that the primary particle size of this hydrophobic silica be 5 to 50 nm and the specific surface area be 50 to 400 m$^2$/g.

As the commercially available hydrophobic silica suitable for attaining the objects of the present invention, there can be mentioned TS-720 and R-972 (supplied by Nippon Aerosil). As the hydrophilic gas-phase method silica, there can be used various grades of ordinary gas-phase method silica. For example, there can be mentioned a product composed solely of silica and gas-phase method silica containing a small amount of alumina (Aerosil MOX80, MOX170 or COK84. It is preferred that the primary particle size of the gas-phase method silica be 5 to 50 nm and the specific surface area be 50 to 400 m$^2$/g. The hydrophobic silica is more electroconductive than the hydrophilic silica, and the volume resistivity is lower than $10^{13}$ Ω-cm.

Various grades of ordinary gas-phase method alumina can be used as the alumina additive. For example, untreated gas-phase method alumina and hydrophobic gas-phase method alumina obtained by surface-treating the gas-phase method alumina with a silane in the same manner as described above with respect to the hydrophobic silica can be used. Also wet method alumina can be used if the particle size is fine. Gas-phase method alumina is preferably used, and gas-phase alumina having a primary particle size of 10 to 500 nm and a specific surface area of 40 to 100 $m^2/g$ is especially preferably used. The alumina additive is readily charged with a positive polarity, in contrast to the silica additive.

Developer

The one-component developer of the present invention is prepared by stirring and mixing the above-mentioned magnetic toner particles with the silica and/or alumina additive particles so that the particle size and area coverage ratio of the adhering additive particles are within the above-mentioned ranges. Necessary and sufficient stirring-mixing should be performed, but excessive stirring-mixing should be adopted.

For example, use of a mixer having a large shearing force, such as an ounce mill or a super mixer, should be avoided, because silica additive particles or alumina additive particles are embedded in the toner particles. Agglomerated particles of the alumina or silica additive are appropriately disintegrated, but application of a compressive force to the mixture should be avoided. From this viewpoint, a Nauta mixer or a Henschel mixer is preferably used. The necessary mixing time depends on the kind of the mixing stirrer and the degree of agglomeration of the alumina or silica additive particles, but it is generally preferred that the mixing time be about 0.5 to about 10 minutes. Of course, there can be adopted a method in which with respect to an optional mixer, relations of the mixing time to the particle size and area coverage ration of the additive particles adhering to the toner are determined by experiments in advance, and an optimum mixing time is set.

The amount incorporated of the additive depends on the coverage area ratio to be set, but it is generally preferred that the amount of the additive be 0.1 to 5.0% by weight, especially 0.5 to 2.0% by weight, based on the magnetic toner particles. In the case where hydrophobic silica and hydrophilic silica are used in combination, it is preferred that both be used at a weight ratio of from 9/1 to 1/9, especially from 6/1 to 1/6, especially particularly from 5/1 to 1/5. In the case where silica and alumina are used in combination, it is preferred that both be used at a weight ratio of from 1/9 to 9/1, especially from 1/5 to 5/1. In the latter case, there is preferably adopted a method in which the alumina additive is first added to make it adhering to the surfaces of the toner particles so that the above-mentioned requirement of the area coverage ratio is satisfied, and then, the silica additive is incorporated to make it adhering to the surfaces of the toner particles.

The one-component magnetic developer of the present invention is supplied on a developing sleeve having magnets built therein to form magnetic brush of the developer, and the magnetic brush is brought in close proximity to or brought into sliding contact with the surface of the photosensitive material to develop the charged image on the surface of the photosensitive material. In case of the proximity development, it is preferred that a vibrating electric field (alternating current electric field) be applied between the developing sleeve and the photosensitive material, and in case of the sliding contact development, it is preferred that a bias electric field be applied between the developing sleeve and the photosensitive material.

As is apparent from the foregoing description, according to the present invention, by selecting magnetic toner particles having a specific sphericity degree (DS) and a specific surface area and dispersing silica or alumina additive particles in the toner particles to make the additive particles adhering to the toner particles to form a developer, the chargeability and flowability of the developer and the image density and image quality can be prominently improved.

EXAMPLES

The present invention will now be described in detail with reference to the following examples that by no means limit the scope of the invention.

EXAMPLE 1

By a Henschel mixer, 100 parts by weight of a styrene/acrylic copolymer (CPR600B supplied by Mitsui-Toatsu), 70 parts by weight of magnetite ($Fe_3O_4$; BL220 supplied by Titan Kogyo), 3 parts by weight of low-molecular-weight polypropylene (Viscol 550P supplied by Sanyo Kasei) and 3 parts by weight of a negative charge-controlling agent (Bontron S-34 supplied by Orient Kagaku) were mixed. The mixture was melt-kneaded by a twin-screw extruder, cooled, roughly pulverized by a rotoplex, finely pulverized by a jet mill and air-sieved by an Alpine classifier to obtain a magnetic toner having a particle size of 5 to 35 $\mu$m.

The obtained toner was subjected to a sphering treatment by using a sphering apparatus of the type giving a turning movement to a powder by an air current.

The sphericity degree of the sphered toner was 85% and the specific surface area was 1.8 $m^2/g$.

Then, 1% by weight, based on the toner, of hydrophobic silica (TS-720 supplied by Nippon Aerosil) was added, and mixing was carried out for 60 seconds by using a Henschel mixer to prepare a magnetic developer of the present invention.

By using the obtained magnetic developer, an image was formed by a laser printer (Model LPX-2 supplied by Mita Industrial Co. Ltd.,), and the image density was measured by a reflection densitometer (supplied by Tokyo Denshoku). The obtained results are shown in Table 1.

Figure 3:
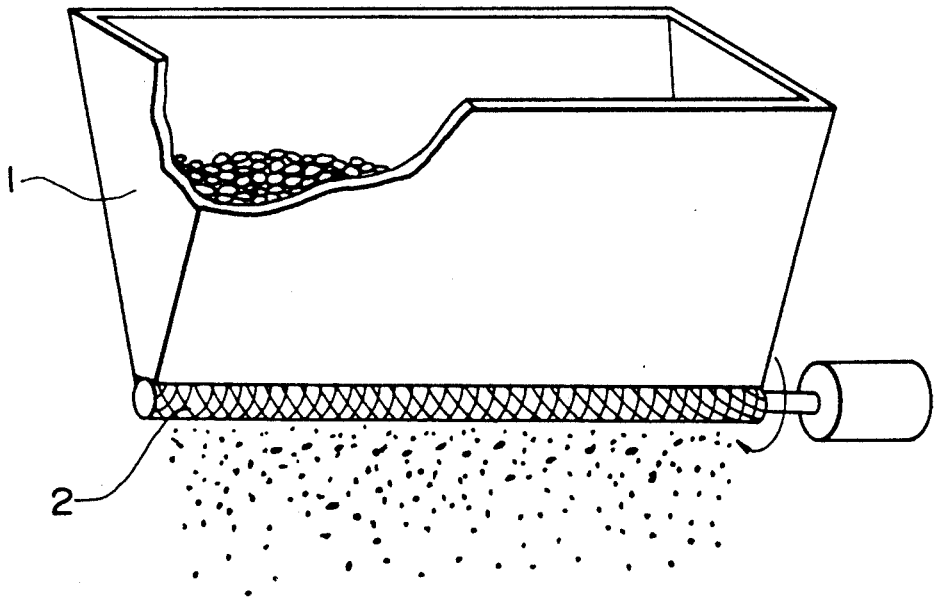
FIG. 3 is a diagram illustrating an apparatus for measuring the falling quantity of the developer.

The flowability of the developer was evaluated according to the following procedures. Namely, 20 g of the magnetic developer was charged in a falling quantity tester 1 shown in FIG. 3, and a knurled metal roller 2 (having a diameter of 20 mm and a length of 135 mm) was rotated for 5 minutes and the falling quantity of the developer was examiner. As the falling quantity of the developer was large, the flowability was excellent. The obtained results are shown in Table 1.

Furthermore, the average particle size of the hydrophobic silica adhering to the toner particles and the area coverage ratio to the toner particles were examined. The average particle size was the value practically measured by a scanning electron microscope. The area coverage ratio was determined by measuring the projected area of the toner, the projected area of the silica and the number of the particles by a scanning electron microscope, and performing the calculation according to the formula (1). The obtained results are shown in Table 2.

COMPARATIVE EXAMPLE 1

A magnetic toner was prepared in the same manner as described in Example 1 except that the sphering treatment was not carried out.

The sphericity degree of this toner was 65%, and the specific surface area was 2.3 $m^2/g$.

Then, in the same manner as described in Example 1, a developer was prepared, and the image density and flowability were evaluated. The obtained results are shown in Table 1.

COMPARATIVE EXAMPLE 2

A mixture comprising 80 parts of styrene, 20 parts by weight of 2-ethylhexyl acrylate, 70 parts by weight of magnetite, 1 part by weight of a negative charge-controlling agent (Bontron S-34 supplied by Orient Kagaku), 1.5 parts by weight of low-molecular-weight polypropylene (Viscol 550P supplied by Sanyo Kasei) and 0.5 parts by weight of divinylbenzene was sufficiently dispersed, and 2 parts by weight of a polymerization initiator (2,2'-azobis-2,4-dimethylvaleronitrile) was dissolved in the dispersion to form a composition. The composition was suspended and dispersed for 15 minutes at 600 rpm in 400 parts of water having 12 parts of calcium triphosphate dispersed therein by using TK Homomixer (supplied by Tokushu Kika Kogyo). Then, polymerization was conducted at 80° C. for 3 hours in a nitrogen gas current. The obtained toner was recovered by filtration and washed with water. This operation was conducted twice to obtain a cake. Then, the obtained cake was dispersed in 400 parts by weight of methanol, and the dispersion was stirred for 30 minutes, filtered and dried to obtain a toner.

The sphericity degree of the toner was 95%, and the specific surface area was 1.0 $m^2/g$.

In the same manner as described in Example 1, a developer was prepared and the image density and flowability were evaluated. The obtained results are shown in Table 1.

EXAMPLE 2

A developer was prepared in the same manner as described in Example 1 except that the time of mixing of the magnetic toner (having a sphericity degree of 85% and a specific surface are of 1.8 $m^2/g$) with the hydrophobic silica was conducted for 10 seconds instead of 60 seconds. In the same manner as described in Example 1, the average particle size of the hydrophobic silica adhering to the toner particles and the area coverage ratio to the toner particles were determined. The image density and flowability were evaluated in the same manner as described in Example 1. The obtained results are shown in Table 2.

EXAMPLE 3

A developer was prepared in the same manner as described in Example 1 except that of mixing of the magnetic toner with the hydrophobic silica was conducted for 180 seconds instead of 60 seconds. In the same manner as described in Example 1, the average particle size and area coverage ratio were determined and the image density and flowability were evaluated. The obtained results are shown in Table 2.

EXAMPLE 4

A developer was prepared in the same manner as described in Example 1 except that 0.5% by weight of hydrophobic silica (R-972 supplied by Nippon Aerosil) and 0.5% by weight of aluminum oxide (alumina) (Aluminium Oxide C supplied by Nippon Aerosil) were simultaneously added to the magnetic toner instead of 1% by weight of the hydrophobic silica (TS-720). In the same manner as described in Example 1, the average particle size of the silica and alumina adhering to the toner and the area coverage ratio to the toner particles were determined, and the image density and flowability were evaluated. The obtained results are shown in Table 3.

EXAMPLE 5

A developer was prepared in the same manner as described in Example 4 except that mixing of the magnetic toner with the silica and alumina was conducted for 10 seconds instead of 60 seconds. In the same manner as described in Example 1, the average particle size and area coverage ratio were determined and the image density and flowability were evaluated. The obtained results are shown in Table 3.

EXAMPLE 6

A developer was prepared in the same manner as described in Example 4 except that mixing of the magnetic toner with the silica and alumina was conducted for 180 seconds instead of 60 seconds. In the same manner as described in Example 1, the average particle size and area coverage ratio were determined and the image density and flowability were evaluated. The obtained results are shown in Table 3.

EXAMPLE 7

A developer was prepared in the same manner as described in Example 4 except that the alumina was first added and mixing was carried out for 30 seconds, and the hydrophobic silica was then added and mixing was conducted for 30 seconds. In the same manner as described in Example 1, the average particle size of the silica alumina adhering to the toner and the area coverage ratio to the toner particles were determined, and the image density and flowability were evaluated. The obtained results are shown in Table 3.

TABLE 1

| | Sphericity Degree (%) | Specific Surface Area ($m^2/g$) | Image Density | Falling Quantity (g/5 min) |
|---|---|---|---|---|
| Example 1 | 85 | 1.8 | 1.36 | 8.27 |
| Comparative Example 1 | 65 | 2.3 | 1.05 | 7.30 |
| Comparative Example 2 | 95 | 1.0 | 1.12 | 8.35 |

TABLE 2

| | Average Particle Size (nm) | Area Coverage Ratio (%) | Image Density | Falling Quantity (g/5 min) |
|---|---|---|---|---|
| Example 1 | 70 | 29 | 1.36 | 8.27 |
| Example 2 | 120 | 52 | 1.25 | 7.92 |
| Example 3 | 70 | 2.8 | 1.23 | 7.81 |

TABLE 3

| | Average Particle Size (nm) | | Area Coverage Ratio (%) | | Image Density | Falling Quantity (g/5 min) |
|---|---|---|---|---|---|---|
| | silica | alumina | silica | alumina | | |
| Example 4 | 70 | 250 | 20 | 1.0 | 1.34 | 8.21 |
| Example 5 | 120 | 250 | 35 | 3.5 | 1.22 | 7.51 |
| Example | 70 | 250 | 2 | 0.04 | 1.29 | 7.86 |

TABLE 3-continued

| | Average Particle Size (nm) | | Area Coverage Ratio (%) | | Image | Falling Quantity |
|---|---|---|---|---|---|---|
| | silica | alumina | silica | alumina | Density | (g/5 min) |
| 6 | | | | | | |
| Example 7 | 70 | 250 | 20 | 1.0 | 1.37 | 8.67 |

We claim:

1. A one-component magnetic developer for electrophotography, which comprises:

one-component magnetic toner particles; and at least one fine particulate additive selected from the group consisting of hydrophobic silica, hydrophilic silica and alumina;

wherein said additive adheres in the form of particles having a particle size of 20 to 100 nm outside the surfaces of said toner particles so that the area coverage ratio to the toner particles is 3 to 30%;

wherein the one-component magnetic toner particles have a sphericity degree of 70 to 90% and a specific surface area of 1.4 to 2.0 $m^2/g$;

said sphericity degree being defined by the formula $$DS = Cc/CT$$

wherein DS represents the sphericity degree,

Cc represents the outer circumference of a circle having the same area as the projected area of the toner, and CT represents the actual outer circumference of the projected area of the toner.

2. A process for producing a one-component electrophotographic developer, which comprises:

mixing particulate alumina having a particle diameter of 100 nm to 1 μm with magnetic toner particles having a sphericity degree of 70 to 90% and a specific surface area of 1.4 to 2.0 $m^2/g$ so that the area coverage ratio to the toner particles is 0.1 to 3%; and then mixing the so-formed admixture with particulate silica having a particle diameter of at least 20 nm to less than 100 nm so that its area coverage ratio to the toner particles is 3 to 30%;

wherein the sphericity degree is defined by the formula $$DS = Cc/CT$$

wherein DS represents the sphericity degree,

Cc represents the outer circumference of a circle having the same area as the projected area of the toner, and CT represents the actual outer circumference of the projected area of the toner.

3. A one-component magnetic developer for the electrophotography, as set forth in claim 1, wherein the additive is a silica additive.

4. A one-component magnetic developer for the electrophotography, as set forth in claim 1, wherein hydrophobic silica and hydrophilic silica are used as the additive at a weight ratio of from 9/1 to 1/9.

5. A one-component magnetic developer for electrophotography, which comprises:

one-component magnetic toner particles; and at least one fine particulate additive selected from the group consisting of hydrophobic silica, hydrophilic silica and alumina;

wherein said silica additive adheres in the form of particles having a particle size of 20 to 100 nm outside the surfaces of the toner particles so that the area coverage ratio to the toner particles is 3 to 30%, and said alumina additive adheres in the form of particles having a particle size of 100 nm to 1 μm outside the surface of the toner particles so that the area coverage ratio to the toner particles is 0.1 to 3%;

wherein the one-component magnetic toner particles have a sphericity degree DS of 70 to 90% and a specific surface area of 1.4 to 2.0 $m^2/g$;

said sphericity degree being defined by the formula $$DS = Cc/CT$$

wherein DS represents the sphericity degree,

Cc represents the outer circumference of a circle having the same area as the projected area of the toner, and CT represents the actual outer circumference of the projected area of the toner.

6. A one-component magnetic developer for the electrophotography, as set forth in claim 5, wherein the silica additive and the alumina additive are used at a weight ratio of from 1/9 to 9/1.

* * * * *